US012522419B2

(12) United States Patent
Spencer

(10) Patent No.: US 12,522,419 B2
(45) Date of Patent: Jan. 13, 2026

(54) SELF-HEATING OR SELF-COOLING SYSTEM AND METHOD

(71) Applicant: Andrew Jhonnie Spencer, Bronx, NY (US)

(72) Inventor: Andrew Jhonnie Spencer, Bronx, NY (US)

( * ) Notice: Subject to any disclaimer, the term of this patent is extended or adjusted under 35 U.S.C. 154(b) by 0 days.

(21) Appl. No.: 17/816,753

(22) Filed: Aug. 2, 2022

(65) Prior Publication Data

US 2023/0039707 A1 Feb. 9, 2023

Related U.S. Application Data

(60) Provisional application No. 63/259,669, filed on Aug. 4, 2021.

(51) Int. Cl.
*B65D 81/32* (2006.01)
*B65D 81/34* (2006.01)
*F25D 5/02* (2006.01)

(52) U.S. Cl.
CPC ..... *B65D 81/3222* (2013.01); *B65D 81/3484* (2013.01); *F25D 5/02* (2013.01); *B65D 2581/3401* (2013.01)

(58) Field of Classification Search
CPC ..... B65D 51/2814; B65D 51/2835; B65D 51/285; B65D 81/3222; B65D 81/3484; B65D 2581/3401; F25D 5/02
USPC ..... 206/219–222, 568
See application file for complete search history.

(56) References Cited

U.S. PATENT DOCUMENTS

| | | | | |
|---|---|---|---|---|
| 2,579,405 | A * | 12/1951 | Sukacev | B65D 81/3876 220/8 |
| 2,615,443 | A | 10/1952 | Sukacev | |
| 3,675,637 | A * | 7/1972 | Trimble | F25D 5/02 126/262 |
| 3,889,483 | A | 6/1975 | Donnelly | |
| 3,970,068 | A | 7/1976 | Sato | |
| 6,351,953 | B1 | 3/2002 | Scudder et al. | |
| 6,364,103 | B1 * | 4/2002 | Sergio | B67B 7/28 141/330 |
| D478,511 | S | 8/2003 | Reynolds | |
| 6,601,577 | B2 | 8/2003 | Bouskila | |
| 6,986,345 | B2 | 1/2006 | Kolb | |
| 7,192,179 | B2 | 3/2007 | Angeletta | |

(Continued)

FOREIGN PATENT DOCUMENTS

EP 3427618 B1 6/2021

*Primary Examiner* — Luan K Bui
(74) *Attorney, Agent, or Firm* — David Guerra

(57) ABSTRACT

A self-heating or self-cooling system and method for providing instant cooling or heating to a product or a surrounding area. The system can include an outer container that is configured to slidably receive an inner container. A piercing member extends from a bottom wall of the outer container and is configured to pierce, break or rupture a sealed end of the inner container so that at least two separate liquids can mix to either create an exothermic reaction that produces heat or an endothermic that absorbs heat or has a cooling effect. The inner and outer containers can be lock in a closed position when the inner container is pushed into the outer container. A sealing arrangement is configured between an interior surface of the outer container and an exterior surface of the inner container to prevent leakage of fluid from the interior chamber of the outer container.

15 Claims, 5 Drawing Sheets

(56) References Cited

U.S. PATENT DOCUMENTS

| | | | | |
|---|---|---|---|---|
| 7,878,188 | B2 | 2/2011 | Barksdale | |
| 8,001,959 | B2 | 8/2011 | Ford et al. | |
| D757,279 | S | 5/2016 | Seidl | |
| D801,118 | S | 10/2017 | Timsit | |
| 10,308,416 | B2 | 6/2019 | Ngoc Thu | |
| 2002/0020636 | A1* | 2/2002 | Bergamini | A61J 1/2093 206/219 |
| 2002/0170834 | A1* | 11/2002 | Lee | B65D 81/3222 206/219 |
| 2005/0035081 | A1 | 2/2005 | Fitch | |
| 2005/0167296 | A1* | 8/2005 | Shenkar | B65D 81/3222 206/219 |
| 2005/0279106 | A1 | 12/2005 | Leonzo et al. | |
| 2007/0006872 | A1 | 1/2007 | Strachan | |
| 2007/0246381 | A1* | 10/2007 | Pond | B65D 51/221 206/528 |
| 2010/0078440 | A1 | 4/2010 | Bargan et al. | |
| 2011/0272301 | A1* | 11/2011 | Saulle | B65D 51/2807 206/219 |
| 2012/0204578 | A1 | 8/2012 | Leavitt et al. | |
| 2013/0098069 | A1 | 4/2013 | Collins | |
| 2015/0021214 | A1* | 1/2015 | Besic | B65D 51/2835 206/222 |
| 2021/0039868 | A1 | 2/2021 | Sabin et al. | |
| 2021/0130072 | A1 | 5/2021 | Sabin et al. | |

* cited by examiner

SELF-HEATING OR SELF-COOLING SYSTEM AND METHOD

CROSS-REFERENCE TO RELATED APPLICATION

This application claims the benefit of priority under 35 U.S.C. § 119(e) based upon U.S. provisional patent application Ser. No. 63/259,669 filed on Aug. 4, 2021. The entire disclosure of the prior provisional application is incorporated herein by reference.

BACKGROUND

Technical Field

The present technology relates to a self-heating or self-cooling system and method for use in connection with instantly cooling or heating a product or a surrounding area.

Background Description

The problem of keeping things cool is the necessity to purchase large bulky bags of ices, which normally last just a few hours. This invention serves to solve that problem by ensuring that the consumer has an instant way of keeping food and beverages cool. Thus, reducing the amount of time and money spent on purchasing ice.

A variety of self-heating or self-cooling beverage and/or food containers is known. These known container typically include a reaction chamber in which two or more reactants are mixed to create heat or cold to the product stored in the container.

These known containers contain complex systems to mix the reactants, which increases the overall expense of manufacture and/or increase the chance of leakage.

It would, therefore, be desirable to provide arrangements for self-heating or self-cooling beverages and/or food that use containers that are simple to manufacture, provide increased leak prevention, and provide a movement locking system.

SUMMARY

The Ice Saber technology provides a meaningful solution rather than purchasing ice. Some embodiments provide an improved way of keeping items cool and safe, by effectively removing the need to purchase large bulky bags of ice. This technology uses a chemical reaction, thus protecting and extending the shelf-life on perishable items or effectively providing instantly cool beverages. These embodiments are stored at room temperature and can be used anytime, anywhere by activating the chemical and water with just a snap. Ice Saber is also non-toxic and environmentally safe.

In view of the foregoing disadvantages inherent in the known types of self-heating or self-cooling containers, the present technology provides a novel self-heating or self-cooling system and method, and overcomes one or more of the mentioned disadvantages and drawbacks of the known types of self-heating or self-cooling containers. As such, the general purpose of the present technology, which will be described subsequently in greater detail, is to provide a new and novel self-heating or self-cooling system and method and method which has all the advantages of the known types of self-heating or self-cooling containers and many novel features that result in a self-heating or self-cooling system and method which is not anticipated, rendered obvious, suggested, or even implied by the known types of self-heating or self-cooling containers, either alone or in any combination thereof.

According to one aspect, the present technology can include a self-heating or self-cooling system including an outer container and inner container. The outer container can define an interior chamber and including a piercing member extending into the interior chamber. The interior chamber can be configured to contain a first substance or fluid. The inner container can be slidably receivable in the interior chamber of the outer container. The inner container can define an interior chamber and includes a sealed wrapper covering an open end of the inner container. The interior chamber of the inner container can be configured to contain a second substance or fluid. The piercing member can be configured to rupture the sealed wrapper when the inner container is pushed a predetermined distance in the outer container so that the first substance or fluid and the second substance or fluid mix to form a mixture that is exothermic or endothermic.

According to another aspect, the present technology can include a self-heating or self-cooling system including an outer container and an inner container. The outer container can include a sidewall, a base wall and a top wall configured to define an interior chamber. The interior chamber can be configured to contain a first substance or fluid. The outer container can include a neck section extending from the top wall. The neck section can define an interior open area and an opening defined through an end wall of the neck section. The neck section can further include a detent extending into the interior open area. The outer container can further include a piercing member extending into the interior chamber from the base wall. The inner container can be slidably receivable in the interior chamber of the outer container. The inner container can include a sidewall and a closed end section configured to define an interior chamber. The interior chamber of the inner container can be configured to contain a second substance or fluid. The inner container can include a sealed wrapper covering an open end of the inner container, and a divot extending into the interior chamber of the inner container and configured to receive the detent of the neck section when the inner container is pushed into the outer container to a position when the divot and the detent are aligned. The piercing member can be configured to rupture the sealed wrapper when the inner container is pushed a predetermined distance in the outer container so that the first substance or fluid and the second substance or fluid mix to form a mixture that is exothermic or endothermic.

According to yet another aspect, the present technology can include a method of heating or cooling a product or surrounding area. The method can include the steps of providing an outer container defining an interior chamber and including a piercing member extending into the interior chamber. The interior chamber can be configured to contain a first substance or fluid. Providing an inner container defining an interior chamber and including a sealed wrapper covering an open end of the inner container. The interior chamber of the inner container can be configured to contain a second substance or fluid. Moving the inner container into the interior chamber of the outer container so that the sealed wrapper moves toward the piercing member. Rupturing the sealed wrapper by the piercing member. Mixing the first substance or fluid and the second substance or fluid to form a mixture configured to create an exothermic or endothermic reaction.

In some or all embodiments, the outer container can include a neck section defining an opening configured to receive therethrough the inner container.

In some or all embodiments, the neck section can include a detent extending into an open area defined by the neck section that receives the inner container.

In some or all embodiments, the inner container can include a closed end section opposite the sealed wrapper. The closed end section can include a divot configured to receive the detent when the inner container is pushed into the outer container to a position when the divot and the detent are aligned.

In some or all embodiments, the neck section can be configured to seal against an exterior surface of the inner container to prevent fluid from leaking out of the interior chamber of the outer container.

In some or all embodiments, the piercing member can have a configuration selected from the group consisting of conical, tapered, ringed and toothed.

In some or all embodiments, the piercing member can include a conical or tapered body featuring one or more teeth extending out therefrom.

In some or all embodiments, the piercing member can include a conical or tapered body concentric with a toothed ring.

In some or all embodiments, the piercing member can include a plurality of radially arranged teeth with gaps defined therebetween configured to allow a flow therethrough.

Some or all embodiments of the present technology can include a straw can be in operable association with any one of or any combination of the outer container and the inner container.

In some or all embodiments, the straw can be integrally formed with a portion of any one of the outer container and the inner container.

Some or all embodiments of the present technology can include a safety seal configured to secure the inner container from being moved into the outer container until the safety seal is removed.

Some or all embodiments of the present technology can include a step of rotating any one of the inner container and the outer container when the piercing member ruptures the sealed wrapper.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is another object of the present technology to provide a new and novel self-heating or self-cooling system and method that may be easily and efficiently manufactured and marketed.

An even further object of the present technology is to provide a new and novel self-heating or self-cooling system and method that has a low cost of manufacture with regard to both materials and labor, and which accordingly is then susceptible of low prices of sale to the consuming public, thereby making such self-heating or self-cooling system and method economically available to the buying public.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology. Whilst multiple objects of the present technology have been identified herein, it will be understood that the claimed present technology is not limited to meeting most or all of the objects identified and that some embodiments of the present technology may meet only one such object or none at all.

BRIEF DESCRIPTION OF THE DRAWINGS

The present technology will be better understood and objects other than those set forth above will become apparent when consideration is given to the following detailed description thereof, with phantom lines (long-short-short-long lines) depicting environmental structure and forming no part of the claimed present technology. Such description makes reference to the annexed drawings wherein:

FIG. 4 is an enlarged cross-sectional view of the piercing member rupturing the sealed wrapper with so the first and second fluids mix to form the mixture.

FIG. 10 is a cross-sectional view of the piercing member taken along line 10-10 in

FIG. 9.

The same reference numerals refer to the same parts throughout the various figures.

DETAILED DESCRIPTION OF THE EMBODIMENTS

While the above-described devices fulfill their respective, particular objectives and requirements, the aforementioned devices or systems do not describe a self-heating or self-cooling system and method that allows for instantly cooling or heating a product or a surrounding area.

A need exists for a new and novel self-heating or self-cooling system and method that can be used for instantly cooling or heating a product or a surrounding area. In this regard, the present technology substantially fulfills this need. In this respect, the self-heating or self-cooling system and method according to the present technology substantially departs from the conventional concepts and designs of the known types of self-heating or self-cooling containers, and in doing so provides an apparatus primarily developed for the purpose of instantly cooling or heating a product or a surrounding area.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

It is to be appreciated that any specific numerical indication of dimension, length, width, height, radius, diameter, thickness and the like is in the exemplary.

Figure 1:
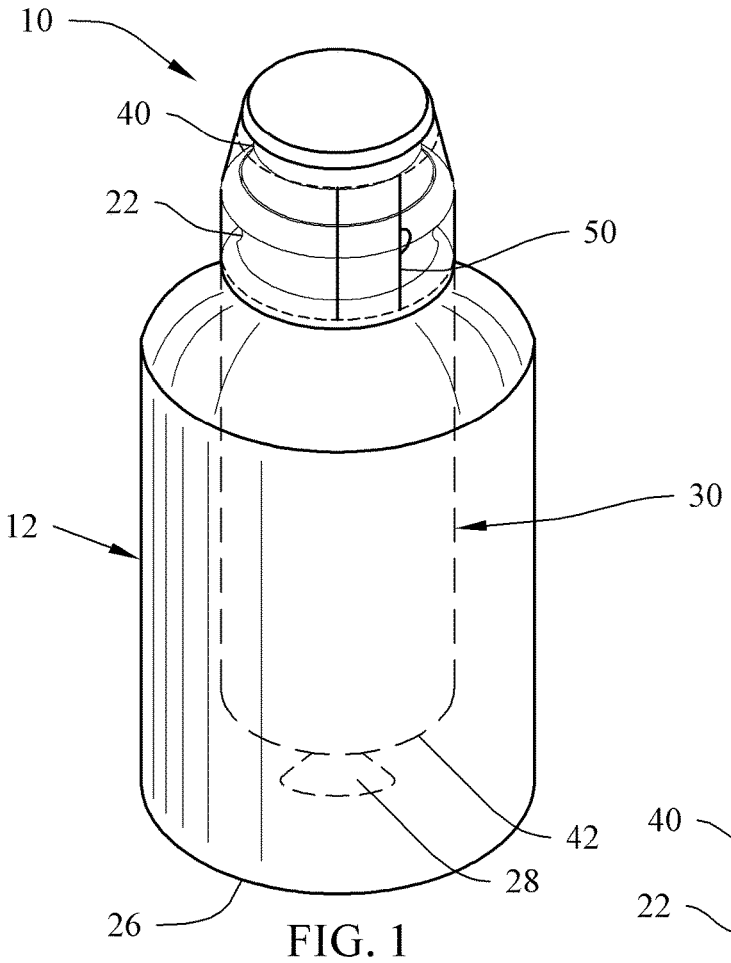
FIG. 1 is a perspective view of the self-heating or self-cooling system of the present technology.

In FIG. 1 a new and novel self-heating or self-cooling system 10 of the present technology for providing instant cooling or heating to a product or a surrounding area is illustrated and will be described. It can be appreciated withing the scope of the present technology that the system 10 can be in the form of containers, bottles, drinking straws, coolers, cans or part thereof. Further, the system 10 can be attachable to a food or beverage apparatus.

More particularly, the self-heating or self-cooling system 10 can include an outer or exterior container 12 that is configured to slidably receive an inner or interior container 30. A piercing member 28 extending from a bottom wall 26 of the outer container 12 can be configured to pierce, break or rupture a sealed end 42 of the inner container 30 so that at least two separate liquids can mix to either create an exothermic reaction that produces heat or an endothermic that absorbs heat or has a cooling effect.

Figure 2:
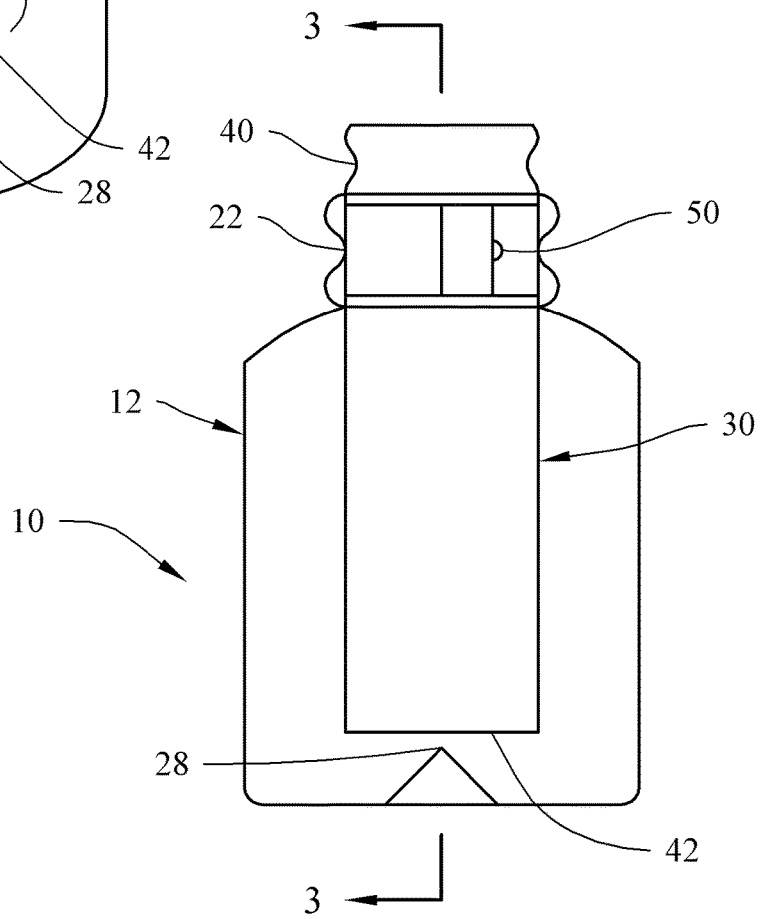
FIG. 2 shows a 2-piece container of the present technology.

In the exemplary, FIG. 2 shows a 2-piece container 10. The lower or exterior container 12 is to be 2⅝" L×3⅝" W with an opening of 1½" in diameter. In the container 12 is a piercing tip 28 centered with a height of 1".

The top container or interior container 30 is 5" tall with a diameter equal to 1½" minus 2 micrometers. Which will allow the interior bottle 30 to move up and down inside the exterior container 12 without leaking its contents.

The interior container 30 has a small divot 40 at its end that will lock on to the exterior container 12 when in the close position. Which will prevent the container 30 from being accidentally opened.

The content (Fluid) of the inside container 30 will be sealed mechanically with a full wrapper 42, which will be able to be punctured when the bottle 30 is pressed down and locked into place, releasing the liquid into the exterior bottle 12 contents, allow the chemical reaction to occur, thus, instantly provides an icy product.

To prevent the accidental activation by piercing the inside container 30 all the way down, a safety zipper 50 made of plastic, seals the two containers 12, 30 together. This will ensure product safety and durability.

Figure 3:
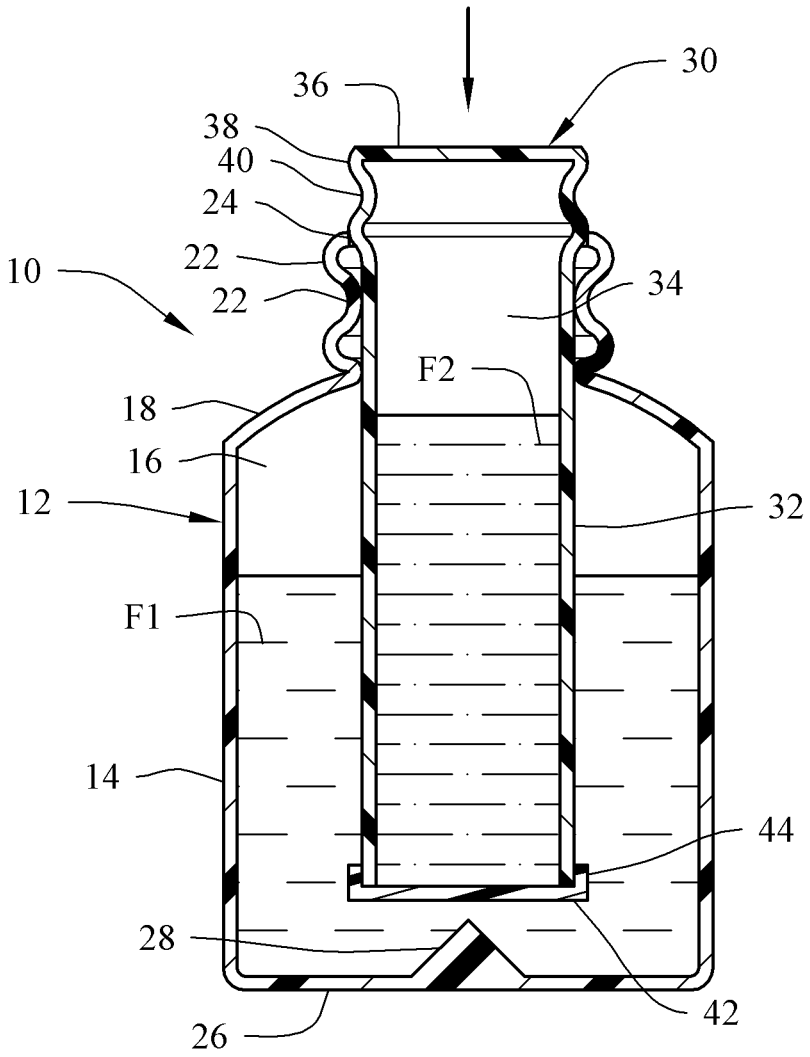
FIG. 3 is a cross-sectional view of the self-heating or self-cooling system in a ready-state position with the first and second fluids not mixed taken along line 3-3 in FIG. 2.

Referring to FIG. 3, the outer container 12 can include an outer container body formed of a sidewall 14, a top wall 18 extending from one end of the sidewall 14, a neck section 20 extending from the top wall 18, and a bottom wall 26 closing off a second end of the sidewall 14. An interior chamber 16 is defined by the sidewall 14, the top wall 18 and the bottom wall 26. The interior chamber 16 is configured to retain and store a first substance or fluid F1.

It can be appreciated that the sidewall 14 can have a cylindrical configuration or can be a plurality of sidewalls forming other geometrical configurations.

The neck section 20 can include a detent 22 extending interiorly therefrom into an open area of the neck section 20 that is in communication with the interior chamber 16. An end wall of the neck section 20 defines an opening 24 configured to slidably receive the inner container 30. The detent 22 can be a one or more detents that can extend radially and inwardly.

The piercing tip or member 28 can extending into the interior chamber 16 from the bottom wall 26. The piercing member 28 can be a conical or tapering extension of the bottom wall 26 or can be attachable thereto.

The inner container 30 can include an inner container body formed of a sidewall 32, a closed end section 36, and the sealed wrapper 42 covering an opened end of the sidewall 32. An interior chamber 34 is defined by the sidewall 32, the closed end section 36 and the sealed wrapper 42. The interior chamber 34 is configured to retain and store a second substance or fluid F2.

The closed end section 36 can include a widened area 38 having a diameter or width greater than the sidewall 32. The divot 40 can extend inwardly from the widened area 38 and can have a configuration that corresponds with the detent 22 allowing the detent 22 to be received in the divot 40.

When the inner container 30 is in a ready-state position, as best illustrated in FIG. 3, the closed end section 36 protrudes out the opening 24 of the outer container 12, with the sidewall 32 received in the interior chamber 16 of the outer container 12. In this ready-state position, the sealed wrapper 42 adjacent the piercing member 28.

The detent 22 and/or an interior edge that forms a transition between the top wall 18 and the neck section 20 that is contact with the sidewall 32 of the inner container 30 forms a contact pressure or clearance sufficient to allow the inner container 30 to slide in or out of the interior chamber 16 of the outer container 12 while not allowing escape of fluid out the opening 24.

In the alternative, a seal or gasket (not shown) can be utilized between any interior surface of the top wall 18 and/or the neck section 20 of the outer container 12 and an exterior surface of the sidewall 32 of the inner container 30. The seal or gasket can be configured to prevent fluid from leaking from the interior chamber 16 and out the opening 24.

The sealed wrapper 42 can extend across the entire open end of the sidewall 32 thereby sealing the second substance or fluid F2 in the interior chamber 34 until ruptured. In the exemplary, the sealed wrapper 42 can include an annular attachment section 44 configured to secure the sealed wrapper 42 to an exterior or interior surface of the sidewall 32. It can be appreciated that the sealed wrapper 42 can be fitted to the open end of the sidewall 32 by other means such as, but not limited to, crimped, clamped, fused, glued, friction fitted, threaded and the like.

Further in the exemplary, the sealed wrapper 42 can be made of the same material as the sidewall 32 as an integrally formed bottom wall with a thickness configured to rupture or break upon a predetermined pressure applied thereto by contact with the piercing member 28. Still further in the exemplary, the sealed wrapper 42 being an integrally formed bottom wall can include weekend or break lines formed therein allowing the bottom wall to rupture or break upon a predetermined pressure applied thereto by contact with the piercing member 28.

It can be appreciated that the sealed wrapper 42 can be removably attached to the open end of the sidewall 32, thereby allowing the sealed wrapper 42 to be replaced after use so that the present technology can be refilled with the first and second substances or fluids F1, F2, respectively, and reused.

Figure 5:
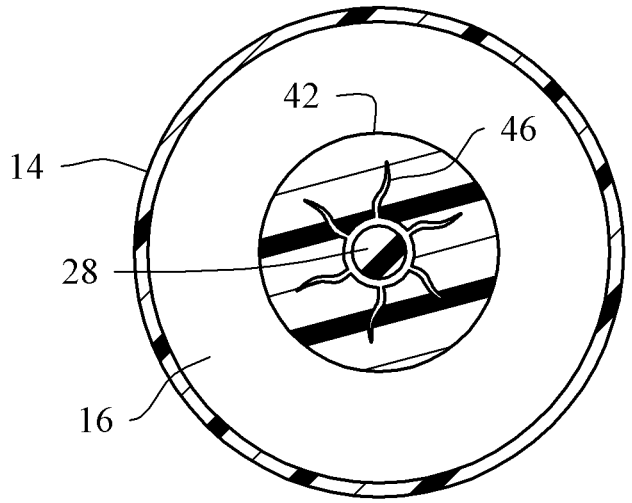
FIG. 5 is a cross-sectional view of the piercing member being operated and rupturing the sealed wrapper taken along line 5-5 in FIG. 4.
Figure 6:
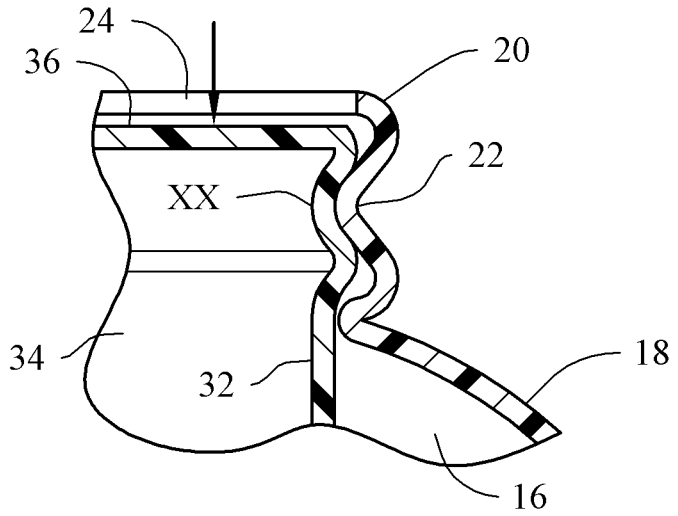
FIG. 6 is an enlarged cross-sectional view of the inner container locked with the outer container in the closed or in use position.

Referring to FIGS. 4-6, the inner container 30 can be pushed into the interior chamber 16 of the outer container 12 to a closed or in-use position where the sealed wrapper 42 is pressed against the piercing member 28 until the sealed wrapper 42 is ruptured. It can be appreciated that the piercing member 28 is configured to rupture or break the sealed wrapper 42 thereby creating ruptures or openings 46 that allows for the free flowing of fluid, as best illustrated in FIGS. 4 and 5.

After rupturing of the sealed wrapper 42, the first and second substances or fluids F1, F2 are able to mix to form a mixture F3 that can either produce heat (self-heating) or absorb heat (self-cooling).

In a typical implementation, the exothermic or endothermic chemical reaction occurs when the first substance or fluid F1 (e.g., a first reactant) comes into contact with the second substance or fluid F2 (e.g., a second reactant) inside the interior chamber 16 of the outer container 12 and/or the interior chamber 34 of the inner container 30. Any one of or any combination of the first and second substances or fluids F1, F2 can be in solid, crystalline or liquid form.

In a self-heating example, one of the reactants can include an oxidizer such as, but not limited to, sodium permanganate, potassium permanganate or calcium permanganate, and the other reactant can include a reducing agent, which may be a polyhydroxy organic compound such, but not limited to, as ethylene glycol, glycerine or propylene glycol. It can be appreciated that any combination of known exothermic combinations can be implemented in the present technology for use as the first and second substances or fluids F1, F2.

In a self-cooling example, one of the reactants can be, but not limited to, water or thionyl chloride, and the other reactant can be, but not limited to, a salt, ammonium nitrate, urea or cobalt(II) chloride hexahydrate. It can be appreciated that any combination of known endothermic combinations can be implemented in the present technology for use as the first and second substances or fluids F1, F2.

Upon continued pushing of the inner container 30 into the interior chamber 16 of the outer container 12, as best illustrated in FIG. 6, the closed end section 36 of the inner container 30 can be partially or fully received in the neck section 20 of the outer container 12 until the detent 22 is received in the divot 40 thereby locking the outer and inner containers 12, 30 in the closed position. The diameter or width of the closed end section 36 and/or the divot 40 can be greater than the diameter or width of the detent 22 thereby creating a snap-lock fitting when in the closed position. This can prevent accidental withdrawal of the inner container 30 from the outer container 12 and/or leakage of the mixture F3.

Figure 7:
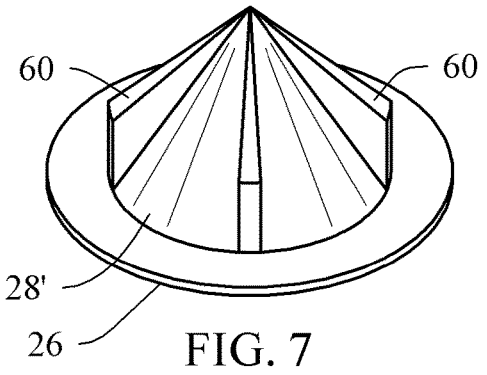
FIG. 7 is a perspective view of an embodiment of the piercing member of the present technology.

In FIG. 7, an alternate piercing member 28' is shown, which includes a conical or tapered body featuring a plurality of tapering teeth 60 extending out therefrom. The teeth 60 can be configured to create larger size ruptures in the sealed wrapper. Further, rotation of the inner container in the closed position would further allow the teeth 60 to tear or cut open a large section of the sealed wrapper, thereby allowing an even great rupture of opening for the flow of fluid.

Figure 8:
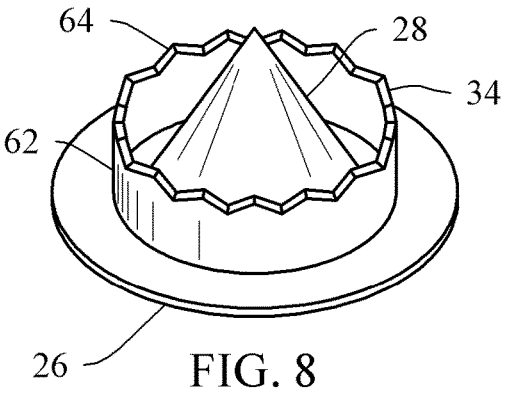
FIG. 8 is a perspective view of an embodiment of the piercing member of the present technology.

In FIG. 8, another alternate piercing member is shown, which includes the piercing member 28 and a ring 62 encircling the piercing member 28. A free edge of the ring 62 can include teeth 64 configured to create large size ruptures in the sealed wrapper and/or to tear or cut a large section of the sealed wrapper, thereby allowing an even great rupture of opening for the flow of fluid.

Figure 9:
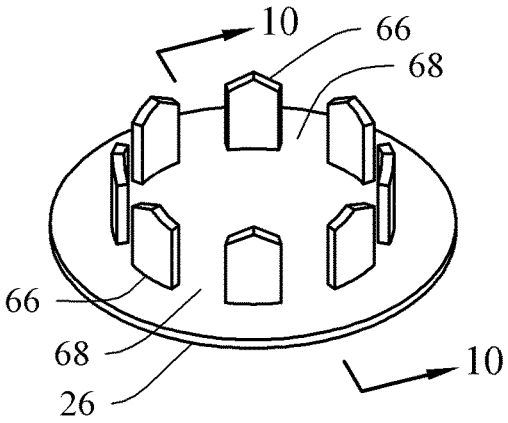
FIG. 9 is a perspective view of an embodiment of the piercing member of the present technology.
Figure 10:
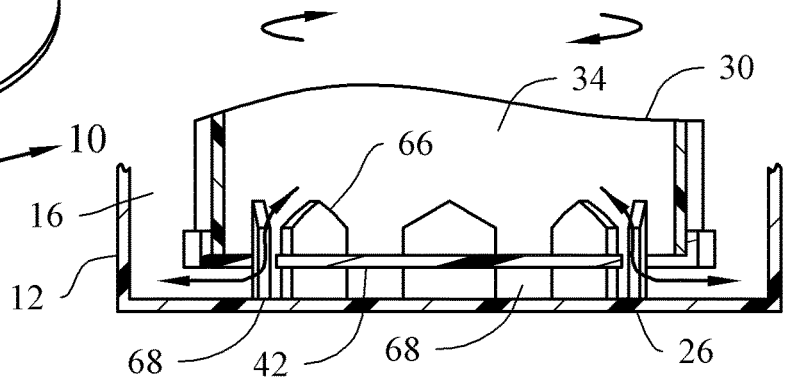

In FIGS. 9 and 10, still yet another alternate piercing member is shown, which omits the conical or tapering piercing member and instead utilizes a plurality of radially arranged teeth 66 with openings or gaps 68 defined therebetween. The teeth 66 can be configured to create large size ruptures in the sealed wrapper and/or to tear or cut a large section of the sealed wrapper, thereby allowing an even great rupture of opening for the flow of fluid. In the exemplary, as best illustrated in FIG. 10, while in the closed position, the inner container 30 can be rotated so that the teeth 66 cuts away a section of the sealed wrapper 42. This creates a large fluid flow path between the interior chamber 34 of the inner container 30 and the interior chamber 16 of the outer container 12. Substances or fluids can then freely flow through the gaps 68 in either direction allowing for thorough mixing of the substances and/or fluids F1, F2 in creating the mixture F3.

Figure 11:
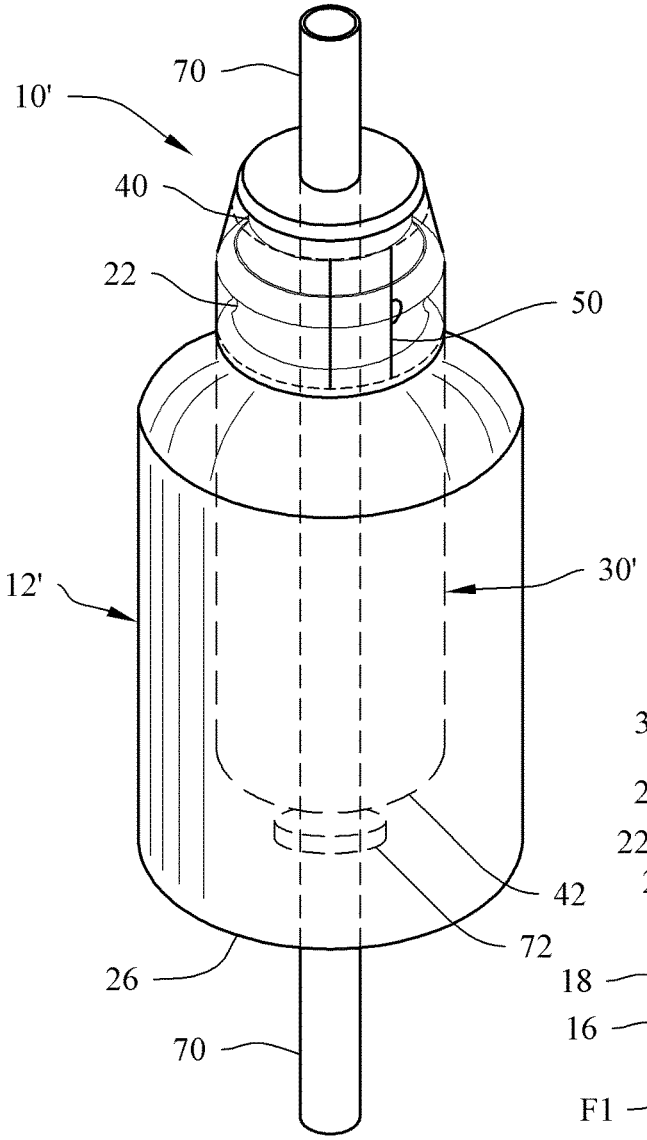
FIG. 11 is a perspective view of the self-heating or self-cooling system of the present technology including or incorporated with a beverage straw.
Figure 12:
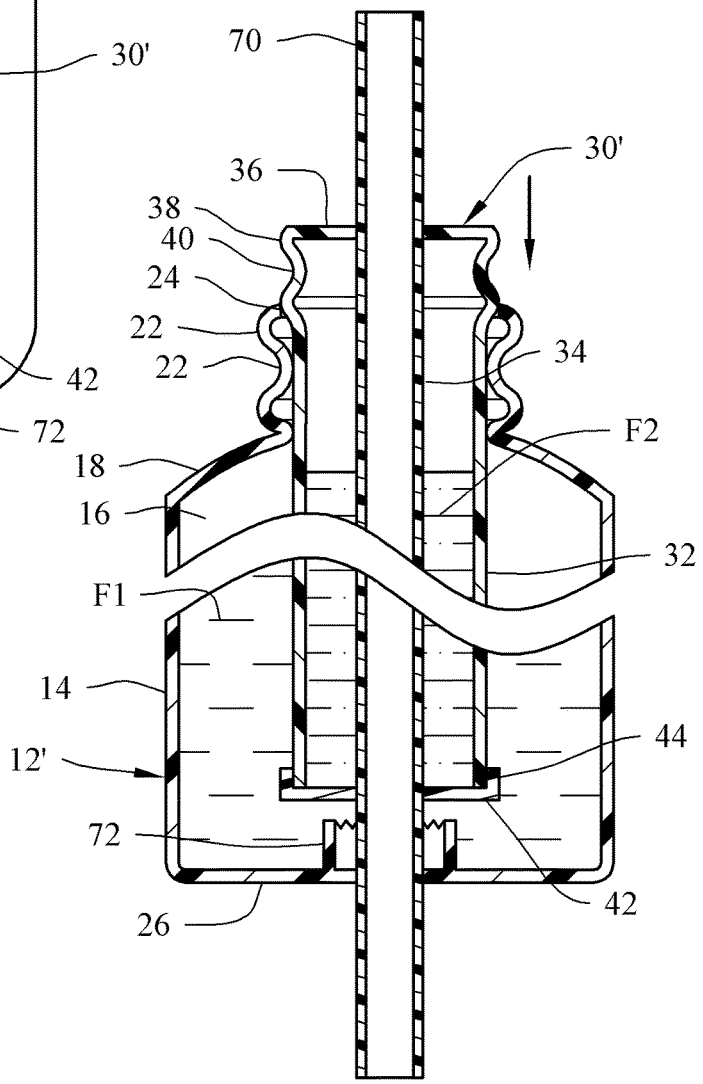
FIG. 12 is a cross-sectional view of the embodiment in FIG. 11 including the beverage straw.

Referring to FIGS. 11 and 12, an embodiment of the self-heating or self-cooling system 10' of the present technology is illustrated and will be described. It can be appreciated withing the scope of the present technology that the system 10' can be in the form of a two-piece container system 12', 30' as similarly described above and including or incorporating a beverage stray 70.

The outer container 12' can include an outer container body formed of the sidewall 14, the top wall 18 extending from one end of the sidewall 14, the neck section 20 extending from the top wall 18, and the bottom wall 26 with a second end of the stray 70 extending out therefrom or passing therethrough. The interior chamber 16 is configured to retain and store the first substance or fluid F1.

The neck section 20 can include the detent 22, and the end wall of the neck section 20 defines the opening 24 configured to slidably receive the inner container 30'.

The piercing tip or member 72 can extending into the interior chamber 16 from the bottom wall 26. The piercing member 72 can be a conical or tapering extension of the bottom wall 26 with a bore defined therethrough configured to receive the straw 70. Alternatively, the piercing member 72 can be a toothed ring or a plurality of radially arranged teeth with openings or gaps defined therebetween with a portion of the stray 70 passing therethrough.

The inner container 30' can include an inner container body formed of the sidewall 32, the closed end section 36 with one end of the stray 70 extending out therefrom or passing therethrough, and the sealed wrapper 42 covering an opened end of the sidewall 32 with one end of the stray 70 extending out therefrom or passing therethrough. The interior chamber 34 is configured to retain and store a second substance or fluid F2 with a portion of the stray 70 passing therethrough.

The closed end section 36 can include the widened area 38 having a diameter or width greater than the sidewall 32. The divot 40 can extend inwardly from the widened area 38 and can have a configuration that corresponds with the detent 22 allowing the detent 22 to be received in the divot 40.

In an embodiment, the straw 70 can be an independent structural element that is received through an opening in the bottom wall 26, an opening in the sealing wrapper 42 and an opening in the closed end section 36, with means or dimensional configuration capable of sealing against an exterior surface of the straw 70. It can be appreciated that the system 10' can be attachable to a standard straw and accordingly provided separately, or can be provide as a kit including the system 10' and the straw 70.

In another embodiment, the stray 70 can be integrally formed with the bottom wall 26 and passing through in a sealed manner an opening in the sealing wrapper 42 and an opening in the closed end section 36.

In yet another embodiment, the stray 70 can be integrally formed with the closed end section 36 and passing through in a sealed manner an opening in the sealing wrapper 42 and an opening in the bottom wall 26.

In still yet another embodiment, the straw 70 can be formed exterior of the system 10' so that the beverage passes along an exterior surface of the outer container 12'.

The embodiment of FIGS. 11 and 12 can be utilized to cool or heat a beverage during drinking by pushing in the inner container 30' so that the piercing member 72 ruptures the sealed wrapper 42 for mixing of the first and second substances or fluids F1, F2. The user can then insert one end of the stray 70 into a beverage and provide suction at the other end to draw the beverage through the straw 70 and consequently through the system 10'.

In use, it can now be understood that the self-heating or self-cooling system 10 of the present technology can be used to provide a self-heating or self-cooling container that can be used to heat or cool an object or surrounding area.

In the ready-state position, at least a portion of the neck section 20 of the outer container 12 and at least a portion of the closed end section 36 of the inner container 30 can be sealed and secured together by the safety seal 50. Further in the ready-state position, the first substance or fluid F1 is contained in the interior chamber 16 of the outer container, and the second substance or fluid F2 is container in the interior chamber 34 of the inner container 30.

Upon use, a user would grab and pull a tab of the safety seal 50 to tear away and remove the safety seal 50. After which, the user can press the closed end section 36 of the inner container 30 to push the sealed wrapper 42 toward the piercing member 28 until the sealed wrapper 42 is ruptured by the piercing member 28. Continued pushing of the closed end section 36 moves the inner container 30 further into the interior chamber 16 of the outer container 12 until the divot 40 receives the detent 22, thereby locking the inner container 30 and the outer container 12 in the closed position.

In the closed position, the first and second substances or fluids F1, F2 are allowed to mix to form the mixture F3 that is configured to create an exothermic or endothermic reaction. To assist in the thorough mixing, the user can shake the outer container 12.

After which, the self-heating or self-cooling system 10 can then be utilized to heat or cool a product, object or surrounding area. For example, the self-heating or self-cooling system 10 can be placed in a cooler or directly in a large liquid container to heat or cool the contents of the cooler or the liquid, respectively.

In an alternative embodiment, the outer and inner containers 12, 30 can be formed as or with a beverage straw (not shown). The outer and inner containers 12, 30 can each include a central tubular wall defining a bore therethrough. The central walls of each of the outer and inner containers 12, 30 would be concentric with their respective sidewall 14, 32. The bore can be configured to include or receive a straw tube. Upon activation of the system 10, any beverage travel through the straw tube would be heated or cooled as it passes through the outer and inner containers 12, 30.

According to one aspect, the present technology can include a self-heating or self-cooling system 10 including an outer container 12 and inner container 30. The outer container 12 can define an interior chamber 16 and including a piercing member 28, 28', 66 extending into the interior chamber 16. The interior chamber 16 can be configured to contain a first substance or fluid F1. The inner container 30 can be slidably receivable in the interior chamber 16 of the outer container 12. The inner container 30 can define an interior chamber 34 and includes a sealed wrapper 42 covering an open end of the inner container 30. The interior chamber 34 of the inner container 30 can be configured to contain a second substance or fluid F2. The piercing member 28, 28', 66 can be configured to rupture the sealed wrapper 42 when the inner container 30 is pushed a predetermined distance in the outer container 12 so that the first substance or fluid F1 and the second substance or fluid F2 mix to form a mixture F3 that is exothermic or endothermic.

According to another aspect, the present technology can include a self-heating or self-cooling system 10 including an outer container 12 and an inner container 30. The outer container can include a sidewall 14, a bottom wall 26 and a top wall 18 configured to define an interior chamber 16. The interior chamber 16 can be configured to contain a first substance or fluid F1. The outer container 12 can include a neck section 20 extending from the top wall 18. The neck section 20 can define an interior open area and an opening 24 defined through an end wall of the neck section 20. The neck section 20 can further include a detent 22 extending into the interior open area. The outer container 12 can further include a piercing member 28, 28', 66 extending into the interior chamber 16 from the bottom wall 26. The inner container 30 can be slidably receivable in the interior chamber 16 of the outer container 12. The inner container 30 can include a sidewall 32 and a closed end section 36 configured to define an interior chamber 34. The interior chamber 34 of the inner container 30 can be configured to contain a second substance or fluid F2. The inner container 30 can include a sealed wrapper 42 covering an open end of the inner container 30, and a divot 40 extending into the interior chamber 34 of the inner container 30 and configured to receive the detent 22 of the neck section 20 when the inner container 30 is pushed into the outer container 12 to a position when the divot 40 and the detent 22 are aligned. The piercing member 28, 28', 66 can be configured to rupture the sealed wrapper 42 when the inner container 30 is pushed a predetermined distance into the outer container 12 so that the first substance or fluid F1 and the second substance or fluid F2 mix to form a mixture F3 that is exothermic or endothermic.

According to another aspect, the present technology can include a method of heating or cooling a product or surrounding area. The method can include the steps of providing an outer container 12 defining an interior chamber 16 and including a piercing member 28, 28', 66 extending into the interior chamber 16. The interior chamber 16 can be configured to contain a first substance or fluid F1. Providing an inner container 30 defining an interior chamber 34 and including a sealed wrapper 42 covering an open end of the inner container 30. The interior chamber 34 of the inner container 30 can be configured to contain a second substance or fluid F2. Moving the inner container 30 into the interior chamber 16 of the outer container 12 so that the sealed wrapper 42 moves toward the piercing member 28, 28', 66. Rupturing the sealed wrapper 42 by the piercing member 28, 28', 66. Mixing the first substance or fluid F1 and the second substance or fluid F2 to form a mixture F3 configured to create an exothermic or endothermic reaction.

In some or all embodiments, the outer container 12 can include a neck section 20 defining an opening 24 configured to receive therethrough the inner container 30.

In some or all embodiments, the neck section 20 can include a detent 22 extending into an open area defined by the neck section 20 that receives the inner container 30.

In some or all embodiments, the inner container 30 can include a closed end section 36 opposite the sealed wrapper 42. The closed end section 36 can include a divot 40 configured to receive the detent 22 when the inner container 30 is pushed into the outer container 12 to a position when the divot 40 and the detent 22 are aligned.

In some or all embodiments, the neck section 20 can be configured to seal against an exterior surface of the inner container 30 to prevent fluid from leaking out of the interior chamber 16 of the outer container 12.

In some or all embodiments, the piercing member can have a configuration selected from the group consisting of conical, tapered, ringed and toothed.

In some or all embodiments, the piercing member can include a conical or tapered body featuring one or more teeth 60 extending out therefrom.

In some or all embodiments, the piercing member can include a conical or tapered body concentric with a toothed ring 62.

In some or all embodiments, the piercing member can include a plurality of radially arranged teeth 66 with gaps 68 defined therebetween configured to allow a flow therethrough.

Some or all embodiments of the present technology can include a straw 70 can be in operable association with any one of or any combination of the outer container 12, 12' and the inner container 30, 30'.

In some or all embodiments, the straw 70 can be integrally formed with a portion of any one of the outer container 12, 12' and the inner container 30, 30'.

Some or all embodiments of the present technology can include a safety seal 50 configured to secure the inner container 30 from being moved into the outer container 12 until the safety seal 50 is removed.

Some or all embodiments of the present technology can include a step of rotating any one of the inner container 30 and the outer container 12 when the piercing member 28, 28', 66 ruptures the sealed wrapper 42.

While embodiments of the self-heating or self-cooling system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A self-heating or self-cooling system comprising:

an outer container defining an interior chamber and including a piercing member extending into the interior chamber, the interior chamber being configured to contain a first substance or fluid; and an inner container slidably receivable in the interior chamber of the outer container, the inner container defining an interior chamber and including a sealed wrapper covering an open end of the inner container, the interior chamber of the inner container being configured to contain a second substance or fluid;

wherein the piercing member being configured to rupture the sealed wrapper when the inner container is pushed a predetermined distance in the outer container so that the first substance or fluid and the second substance or fluid mix to form a mixture that is exothermic or endothermic;

wherein the outer container includes a neck section defining an opening configured to receive therethrough the inner container;

wherein the neck section is configured to seal against an exterior surface of the inner container to prevent fluid from leaking out of the interior chamber of the outer container.

2. The self-heating or self-cooling system of claim 1, wherein the neck section includes a detent extending into an open area defined by the neck section that receives the inner container.

3. The self-heating or self-cooling system of claim 2, wherein the inner container includes a closed end section opposite the sealed wrapper, the closed end section includes a divot configured to receive the detent when the inner container is pushed into the outer container to a position when the divot and the detent are aligned.

4. The self-heating or self-cooling system of claim 1, wherein the piercing member has a configuration selected from the group consisting of conical, tapered, ringed and toothed.

5. The self-heating or self-cooling system of claim 1 further comprising a safety seal configured to secure the inner container from being moved into the outer container until the safety seal is removed.

6. The self-heating or self-cooling system of claim 1 further comprising a straw in operable association with any one of or any combination of the outer container and the inner container.

7. The self-heating or self-cooling system of claim 6, wherein the straw is integrally formed with a portion of any one of the outer container and the inner container.

8. A self-heating or self-cooling system comprising:

an outer container comprising:

a sidewall, a bottom wall and a top wall configured to define an interior chamber, the interior chamber being configured to contain a first substance or fluid;

a neck section extending from the top wall, the neck section defining an interior open area and an opening defined through an end wall of the neck section, the neck section further including a detent extending into the interior open area; and a piercing member extending into the interior chamber from the bottom wall;

an inner container slidably receivable in the interior chamber of the outer container, the inner container comprising:

a sidewall and a closed end section configured to define an interior chamber, the interior chamber of the inner container being configured to contain a second substance or fluid;

a sealed wrapper covering an open end of the inner container; and a divot extending into the interior chamber of the inner container and configured to receive the detent of the neck section when the inner container is pushed into the outer container to a position when the divot and the detent are aligned;

wherein the piercing member being configured to rupture the sealed wrapper when the inner container is pushed a predetermined distance in the outer container so that the first substance or fluid and the second substance or fluid mix to form a mixture that is exothermic or endothermic.

9. The self-heating or self-cooling system of claim 8, wherein the neck section is configured to seal against an exterior surface of the inner container to prevent fluid from leaking out of the interior chamber of the outer container.

10. The self-heating or self-cooling system of claim 8, wherein the piercing member has a configuration selected from the group consisting of conical, tapered, ringed and toothed.

11. The self-heating or self-cooling system of claim 8 further comprising a safety seal configured to secure the inner container from being moved into the outer container until the safety seal is removed.

12. The self-heating or self-cooling system of claim 8 further comprising a straw in operable association with any one of or any combination of the outer container and the inner container.

13. The self-heating or self-cooling system of claim 12, wherein the straw is integrally formed with a portion of any one of the outer container and the inner container.

14. A method of heating or cooling a product or surrounding area, the method comprising the steps of:

a) providing an outer container defining an interior chamber and including a piercing member extending into the interior chamber, the interior chamber being configured to contain a first substance or fluid;

b) providing an inner container defining an interior chamber and including a sealed wrapper covering an open end of the inner container, the interior chamber of the inner container being configured to contain a second substance or fluid;

c) moving the inner container into the interior chamber of the outer container so that the sealed wrapper moves toward the piercing member;

d) rupturing the sealed wrapper by the piercing member; and e) mixing the first substance or fluid and the second substance or fluid to form a mixture configured to create an exothermic or endothermic reaction; and f) locking the inner container with the outer container by pushing the inner container into the interior chamber of the outer container until a detent of the outer container is received in a divot of the inner container.

15. The method of claim 14 further comprising the step of rotating any one of the inner container and the outer container when the piercing member ruptures the sealed wrapper.

* * * * *